United States Patent [19]

Fincher

[11] Patent Number: 4,533,827

[45] Date of Patent: Aug. 6, 1985

[54] OPTICAL JOYSTICK

[75] Inventor: Jeffrey L. Fincher, Spring, Tex.

[73] Assignee: Texas A&M University, College Station, Tex.

[21] Appl. No.: 433,006

[22] Filed: Oct. 6, 1982

[51] Int. Cl.[3] ..... H01J 40/14

[52] U.S. Cl. ..... 250/211 K; 250/221

[58] Field of Search ..... 250/211 K, 221, 201, 250/231 GY; 273/313; 340/709, 365 R; 364/190; 377/17, 42; 338/128; 33/1 M

[56] References Cited

U.S. PATENT DOCUMENTS

| | | | |
|---|---|---|---|
| 2,959,060 | 11/1960 | Kunz | 250/231 GY |
| 3,071,976 | 1/1963 | Kunz | 250/231 GY |
| 3,270,567 | 9/1966 | Crampton | 250/231 GY |
| 3,328,595 | 6/1967 | Todd | 250/231 GY |
| 3,521,072 | 7/1970 | Wipson et al. | 250/221 |
| 3,679,906 | 7/1972 | Myers | 250/221 |
| 3,745,966 | 7/1973 | Seager | 338/128 |
| 3,886,361 | 5/1975 | Wester | 250/231 GY |
| 3,915,019 | 10/1975 | Zoltan | 250/231 GY |
| 3,940,674 | 2/1976 | Gill | 338/128 |
| 4,161,726 | 7/1979 | Burson et al. | 340/365 R |

*Primary Examiner*—David C. Nelms
*Assistant Examiner*—J. Gatto
*Attorney, Agent, or Firm*—Vaden, Eickenroht, Thompson & Jamison

[57] ABSTRACT

Disclosed is a joystick apparatus for effecting a plurality of variable voltage changes using one or more partial spheres concentrically mounted on the joystick shaft having longitudinally or latitudinally variable, light-detectable surfaces. A first light emitter/detector combination senses a first Cartesian coordinate axis tilting movement of the joystick control shaft and a second light emitter/detector combination senses a second Cartesian coordinate axis tilting movement of the control shaft to produce corresponding first and second voltages indicative of joystick position in the respective Cartesian coordinate directions. A handle portion of the joystick is rotatable and connected for carrying, in the preferred embodiment, a second spherical surface concentric with the first, and having a latitudinally variable, light-detectable surface. A third light emitter/detector combination senses the rotational movement of the shaft to produce a corresponding third voltage output. A thumb control rod extending from the free end of the joystick handle may also be provided to achieve two Cartesian coordinate axes by tilting of the thumb rod with respect to a third axis and utilizes a miniature spherical surface of similar structure to the first spherical surface. Suitable orthogonal light emitter/detector combinations with respect thereto provide respective fourth and fifth voltage outputs. In a preferred arrangement, each of the emitter/detector combinations discussed above is preferably connected in a differential mode with another, in-line similar combination to minimize the effects of surface and component aging, eccentricities in initial mounting and the effects of wear in the mounting structures.

19 Claims, 9 Drawing Figures

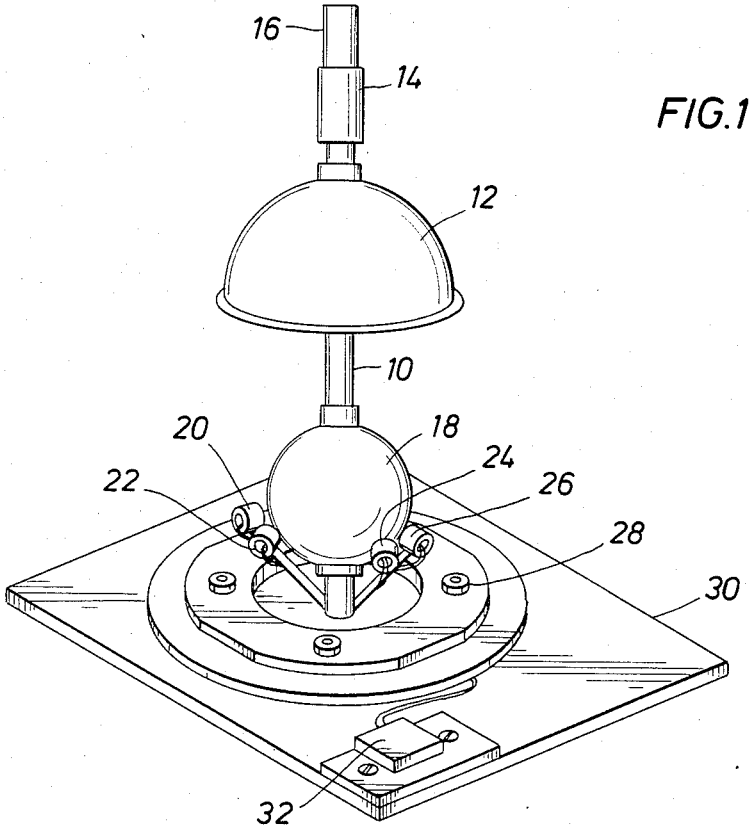
FIG.1
FIG. 2
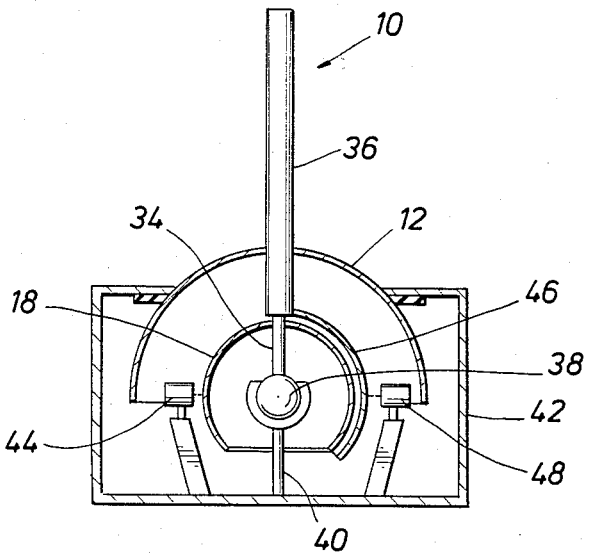

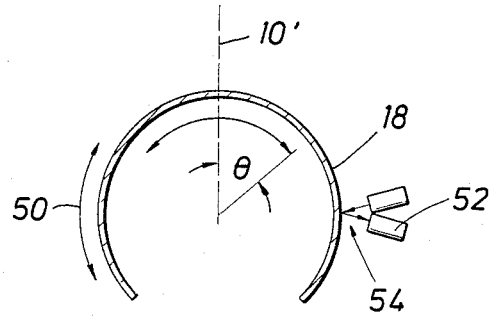
FIG. 3
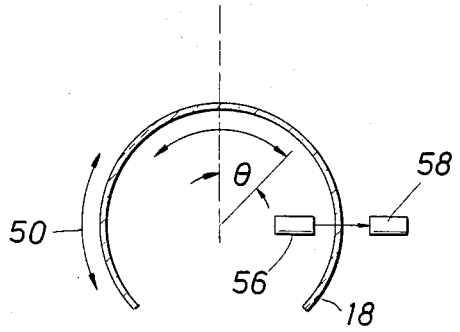
FIG. 4
FIG. 5
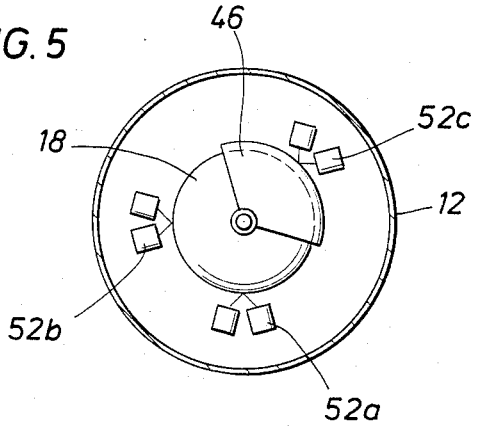
FIG. 6
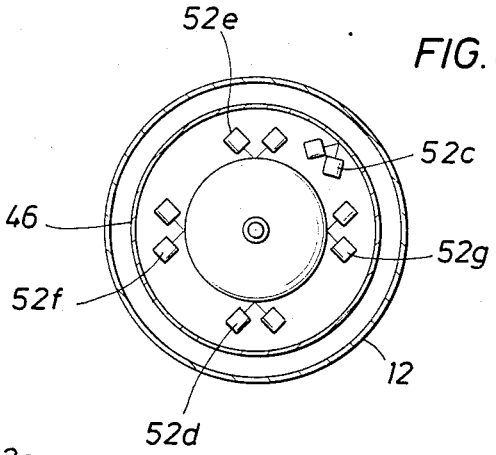
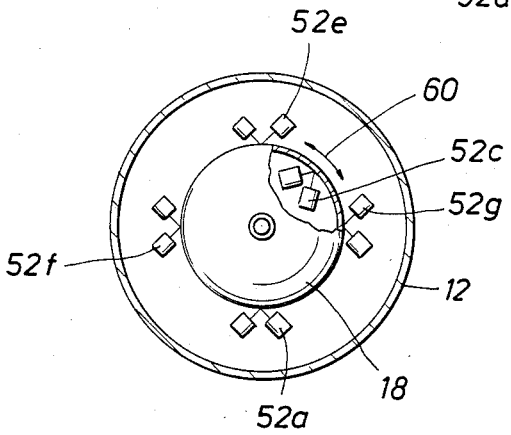
FIG. 7

OPTICAL JOYSTICK

BACKGROUND OF THE INVENTION

1. Field of the Invention

This invention pertains to multi-positional controls and more specifically to such a control that provides multiple electrical control outputs dependent on the multi-positional manipulations of such control, which control is commonly referred to as a "joystick".

2. Description of the Prior Art

Joystick controllers have long been employed in aviation as a convenient means of providing the pilot with an easy manipulative control over one or more controlled devices. That is, by positioning the joystick front to back, the attitude of the plane is lowered or raised, the external devices achieving such action being controlled by the joystick. In similar fashion, positioning the joystick to the left or to the right causes corresponding banking and ultimate turning of the aircraft through the controlled wing and tail parts that achieve such action. The pilot can accomplish both these controlled actions simultaneously by moving a single stick, while still being able to use the other free hand for operating other controls.

Joysticks are useful in other applications besides aircraft control. For example, a handicapped person might be able to operate a small handle to control a wheelchair or even a more complex machine but not be able to operate a wheel or even multiple switches or buttons. These actions either require more strength, complex physical dexterity or a different dexterity than is required in a simple single stick control operation.

The boom in video and other modern games has presented a need for more rugged, yet not overly complex controllers. For example, a player often must achieve complex manipulation of parts and/or the manipulation of multiple parts during the course of play and must make these manipulations over and over again. The newer three-dimensional games place an even further movement requirement on the pieces and requires further demands to the control apparatus for moving these pieces not only with respect to the axes of a planar surface or board, but with respect to the depth or perspective dimension. Consider, for example, the controls required to manipulate a video game "spaceship" through a three-dimensional field of "asteroids".

The examples of use are numerous. The above applications are merely by way of example and not limitation.

Joysticks in the past have achieved their functions by converting the angular motion of a control rod to circular motion about two perpendicular axes, thereby rotating a potentiometer or variable resistor in each of the two axes. Thus, the operator is provided with two separate control outputs. Although operationally satisfactory in most cases, the type of construction just described has a short lifetime because the carbon tracks in the potentiometer wear out with repeated usage. Deterioration may cause output discontinuities as well as gradual value changes which could result in inaccurate and perhaps even harmful results. Furthermore, since sufficient force must be exerted on the control rod to overcome the wiper friction in the potentiometer, the control manipulation may be difficult for the weak or handicapped. Also, such drag causes the precision and/or sensitivity of control not to be as great as one would want in many cases. Moreover, to achieve more than two independent varying output signals by manipulating a single stick has not been readily possible using multiple-axes potentiometers.

Prior art patents in joysticks using optical devices include the structures described in U.S. Pat. Nos. 3,521,072 (Wipson, et al.); 3,811,047 (Shagral); and 3,886,381 (Wester). Wipson, et al. discloses a pivotal control shaft with a mask element disposed between a light emitter and dual photoconductors as detectors. The mask shades both photoconductors when the shaft is in a central neutral position, but uncovers one or the other of these photoconductors when the shaft is tilted to produce a positive or a negative signal, thereby achieving a servocontrol type output. A second mask element with a second set of photoconductors are used for servocontrol purposes in an orthogonal direction.

Shagral uses four spaced apart light receivers illuminated by a pivoted shaft-mounted light. As the light is pivoted, the pattern on the light receivers is varied, providing comparative information.

Wester utilizes eccentric arcuate surfaces mounted vis-a-vis a control shaft. Variation in distance of the surface from detectors differentially connected together reveals information. The two orthogonal axes are not independent. Furthermore, it should be noted that the fulcrum is preferably a rubberized diaphragm for automatic approximate resetting of the shaft.

Many patents show structures unrelated to joysticks that utilize optical detection for servocontrol purposes. For example, U.S. Pat. Nos. 3,071,976 (Kunz) and 3,270,567 (Crampton) shows structures which optically detect a rotating or spinning spherical gyroscope surface using a light emitter/detector combination. U.S. Pat. No. 3,770,965 (Edwards, et al.) reveals the utilization of a graduated slot connected to a galvanometer photosensor feedback loop. A photosensor feedback signal detecting the slot size and servocontrols the galvanometer back to a neutral position. U.S. Pat. No. 4,103,155 (Clark) discloses the production of an indication of the degree of cylinder rotation using sensors detecting a graduated darkened pattern on the surface of the cylinder.

The following U.S. patents pertain generally to photoresistor elements: U.S. Pat. Nos. 3,258,601 (Suleski); 3,358,150 (Summer): 3,639,769 (Clark): and 3,859,617 (Oka, et al.). None of these patents pertain to a joystick application and the structures are all dissimilar to anything disclosed in the preferred embodiments of the present invention.

Therefore, it is a feature of the present invention to provide an improved joystick using optical principles in such a manner to provide multiple outputs through the manipulation of a single rod.

It is another feature of the present invention to provide an improved optical joystick including a sphere with a changing-property surface, such as by paint or otherwise, the surface being optically detectable with position changes in the joystick to produce electrical outputs corresponding to the optically detected surface changes.

It is still another feature of the present invention to provide an improved optical joystick which produces three outputs, one in response to a forward and backward movement of the joystick, one in response to a sideways movement, and one with a rotation manipulation of the joystick.

It is yet another feature of the present invention to provide an improved optical joystick which has three outputs dependent on the manipulation thereof and includes, in addition, a concentrically mounted thumb control for providing additional outputs dependent on thumb manipulations thereof, these additional outputs obtainable via another and miniature sphere also with a gradual changing surface.

SUMMARY OF THE INVENTION

The disclosed invention embodiments pertain to a joystick pivotally mounted preferably via a ball joint, for motion back-and-forth, sideways and in between. The shaft of the joystick carries with it a rigidly mounted spherical surface gradually coated or otherwise gradually varying in physical optical-detection property from bottom to top (i.e., longitudinally). Positioned for either reflectivity detection or transmissive detection is a light emitter/detector combination (or, preferably two light emitter/detector combinations in a differential mode) in the two primary orthogonal movement directions. That is, as the shaft is tilted, the reflectivity (or, alternately, the transmissivity) of the spherical surface gradually changes to provide a corresponding gradually changing output from the detector (or, from a differentially connected pair of detectors).

At least a part of the shaft is also preferably mounted for rotation and in a preferred embodiment includes a second spherical surface, similar to the first, that changes in optical detection property latitudinally, rather than longitudinally. Another light emitter/detector combination (or, differentially connected emitter/detector pair of combinations) is connected to provide a varying output dependent on the degree of shaft rotation. A thumb rod or second shaft may be preferably mounted in the handle of the joystick shaft just described which also carries or has mounted therein a miniature sphere and an emitter/detector combination scheme similar to that which is connected in conjunction with detecting surface changes in the first sphere. Therefore, as the thumb shaft is pushed forward or pulled backward, a fourth output is produced, and as the thumb shaft is pushed to one side or the other with respect to the primary shaft, a fifth output is produced.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the drawings, which drawings form a part of this specification. It is to be noted, however, that the appended drawings illustrate only preferred embodiments of the invention and are, therefore, not to be considered limiting of its scope for the invention may admit to other equally effective embodiments.

In the drawings:

FIG. 1 is a pictorial illustration of the primary shaft and the first partial sphere and related emitter/detector portion of an optical joystick in accordance with the present invention, the light and dust cover being raised from its position of use to reveal these pertinent constituent parts.

FIG. 2 is a schematic representation in vertical cross section of an embodiment of the present invention showing two spherical surfaces manipulatable by a single joystick shaft.

FIG. 3 is a schematic representation of a partial sphere in accordance with the present invention, a light emitter and a light detector being shown for operation with respect to a surface of varying reflectivity.

FIG. 4 is a schematic representation of a partial sphere in accordance with the present invention, a light emitter and a light detector being shown for operation with respect to a spherical surface of varying transparency.

FIG. 5 is a schematic representation of a top view of a first embodiment of the present invention showing emitter/detector combinations with respect to spherical, varying reflectivity surfaces in accordance with the present invention.

FIG. 6 is a top view schematic representation of emitter/detector combinations with respect to varying reflectivity surfaces of partial spheres in accordance with an alternate embodiment of the present invention.

FIG. 7 is a schematic representation of a top view of emitter/detector combinations with respect to varying reflectivity inner and outer surfaces of a partial sphere in accordance with an alternate embodiment of the present invention.

DESCRIPTION OF PREFERRED EMBODIMENTS

Figure 8:
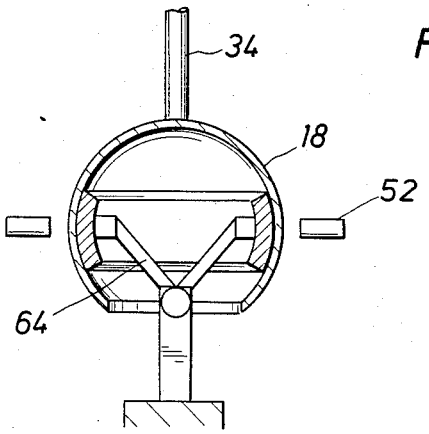
FIG. 8 is a representation in schematic form of an alternate mounting means for a partial sphere in accordance with the present invention.

Now referring to the drawings and first to FIG. 1, part of an embodiment of an optical joystick in accordance with the present invention is shown in a pictorial view. For purposes of this application, the term "joystick" applies to any control apparatus having a tilting shaft, although commonly the term applies to such apparatus that are controlled by a stick handle which is hand-held and manipulated. Control shaft 10 of the joystick is mounted through a spherical light and dust cover 12 and extends for convenient hand-holding for manipulative purposes at handle 14. As will be later explained, a thumb shaft or rod 16 may also extend from the end of handle 14 and is independently manipulative. Rigidly mounted on shaft 10 is a spherical surface in the form of a partial sphere 18, the outer surface thereof gradually varying in optical detection property from top to bottom in accordance with the description which follows hereafter. It is assumed that the neutral or central position of shaft 10 is vertical and that it is pivoted with respect to a ball joint, although this joint is not visible because of sphere 18. Horizontally aligned with the center of the ball joint mounting internal to sphere 18 is a light emitter or source 20 and a cooperating light detector 22. At an orthogonal position with respect to source or emitter 20 and detector 22 are located a similar source 24 and detector 26 combination. The entire assembly of parts just described are conveniently mounted by a nut-and-bolt arrangement 28 to a mounting plate 30 and the electrical connections are brought out to convenient terminals 32. A housing, not shown, is usually placed over the plate and outer sphere as hereinafter described in conjunction with the FIG. 9 embodiment.

FIG. 2 shows a vertical cross-section of a first embodiment of the present invention. Control rod 10 comprises an inner shaft 34 and an outer shaft 36. Inner shaft 34 conveniently terminates in the ball portion of ball joint 38. A support 40 for the ball is rigidly secured to the bottom plate portion of housing 42. A partial sphere 18 is rigidly mounted to inner shaft 34, the surface thereof extending on either side of ball 38 and below it to some extent. The center of rotation for sphere 18 is the center of ball joint 38. When inner shaft 34 is pivoted to the left, the open end of sphere 18 will be brought close to mounting structure 40. The opening in the bottom of sphere 18 is sufficient to permit the desired amount of movement. The opening is also sufficient to permit similar pivoting to the right. Mounting structure 40 is rigidly affixed to housing 42.

Also rigidly mounted to housing 42 is an optical or light emitter and detector combination, illustrated as a unit 44 in the drawing. The emitter and detector parts of the unit do not vary in distance from the surface of sphere 18 as control rod 10 is manipulated.

In similar fashion, outer shaft 36, concentric to shaft 34, is mounted to a partial sphere 46. Sphere 46 is concentric with sphere 18 and is spaced apart therefrom. Outer shaft is mounted by means (not shown) so as to rotate around inner shaft 34 and carry with it sphere 46. It is also operable in such a fashion so as not to interfere with the emitter/detector combinations related to operation of sphere 18. Mounted opposite the surface of sphere 46 is another emitter/detector combination 48 rigidly mounted to housing 42. As sphere 46 rotates about the center of rotation, which is also located in the center of ball joint 38, the distance of the surface of sphere 36 to emitter/detector 48 does not vary.

It may be seen by reference to FIG. 3, that the angle of movement of sphere 18 with respect to neutral position 10' for rod 10 is angle $\theta$ to the right and equal angle $\theta$ (not shown) to the left. The movement of sphere 18 through both angles $\theta$ moves the surface of the sphere over a circumferential distance 50 past light emitter/detector combination 52 located for observing the changes of the condition on the surface of the sphere as it passes point 54. Point 54 is on a horizontal line passing through the center of rotation for sphere 18. It should be noted that the distance of point 54 from the emitter/detector combination remains constant. It is only the optical condition or property of the surface which is the variable factor.

It may be seen that if paint is used for coating the surface which varies gradually from pure white to pure black as perceived by the emitter/detector combinations, over distance 50, then the reflectivity possibilities go through a complete range of change over that distance. Alternately, the change could be from black to white rather than from white to black.

FIG. 4 also shows a hollow sphere 18. In this embodiment, there is a light emitter 56 located internally to the sphere and a light detector 58 external thereto. The sphere itself is transparent; however, the surface has been treated so as to vary between being absolutely transparent at one extent of surface movement 50 to being completely opaque at the other extreme. The change therebetween is gradual or variable in a predetermined manner, such as linearly, or otherwise. It will be seen that the distance between the light emitter and the internal surface of sphere 18 does not vary during positional change of sphere 18 and the distance between the external surface of sphere 18 and light detector 58 likewise does not vary as the position of the sphere changes. Alternative to the above arrangement, the emitter and detector could be reversed in position.

Now referring to FIG. 5, a top view of partial sphere 18 and a view of partial sphere 46 is shown according to the first embodiment of the invention. It will be seen that sphere 18 operates in conjunction with two emitter/detector combinations **52*a* and 52*b* of the type just described for FIG. 3. As the control shaft is moved forward and backward, please note that there is no change in the detection of reflectivity by combination 52*b*. However, the range of reflectivity at 52*a* changes to whatever extent the shaft is moved. In similar fashion, a movement of the control shaft from left to right does not change the reflectivity which is detected at combination 52*a*; however, the change of reflectivity is fully perceived by combination 52*b*. It may be seen that a movement of the shaft at an angle between the positions just described will have an effect on the reflectivity detected at both combinations 52*a* and 52*b***.

Spherical surface 46 is connected for rotation as outer shaft 36 of control rod 10 is rotated. Combination **52*c* detects the change of reflectivity of the external surface thereof, there being a variation in surface reflectivity in the longitudinal direction around sphere 46. The reflectivity surface condition does not change depending upon the amount of tilt of the shaft since everything along a common longitudinal plane on sphere 46 is made of equal reflectivity. Keeping the same longitudinal great circle of sphere 46 underneath detector 52*c*, that is under detector 52*c* when the joystick is in the null position for the third degree of freedom, regardless of tilt of the shaft, maintains zero rotation of sphere 46 in the third degree of freedom. An alternate and preferred arrangement for emitter/detector combinations is shown in FIG. 6. Please note that two combinations 52*d* and 52*e* are shown in alignment for detecting movement of the shaft backwards and forwards and combinations 52*f* and 52*g* are shown in alignment for detecting changes in the reflectivity of sphere 18** from side to side. It is advantageous that these respective combinations are connected in a differential mode to compensate for aging in the surface condition, aging of electronic component parts, inadvertent variation in and distance of surface to emitter/detector combination and the like.

There are two ways that two emitter/detector combinations located 180° apart and a gradually varying spherical surface can provide a differential mode connection. The first way is to have a surface which uniformly varies from bottom to top in the same direction. As the spherical surface is varied from dark to light past the first emitter/detector combination, the spherical surface varies from light to dark past the other. Therefore, there must be inserted a bias reversal connection or some other means for allowing detection of surface reflectivity changes in the intended manner and not cancellation. The other way of achieving the same result is to change the coating on one-half of the sphere with respect to the other; however, since a particular part of the surface may determine the detected reflectivity for an orthogonally positioned emitter/detector combination as well as the in-line combination when the control shaft is at an angular position, such a coating scheme may be more difficult to achieve than the reversal of an electronic connection.

Also shown in FIG. 6 is an alternate positioning of emitter/detector combination **52*c* used to detect variation in reflectivity of the surface of sphere 46 according to the first embodiment of the invention. In this particular arrangement, combination 52c is shown in opposition to the inside, rather than outside, surface of sphere 46**.

In a further alternate embodiment of the present invention, as shown in FIG. 7, center sphere 46 may be eliminated by treating the inner surface of inner sphere 18 to exhibit a longitudinal variation in reflectivity, as previously described with respect to the center sphere. Inner sphere 18 may be adapted to rotate along circumferential direction 60 with movement of the handle around the control shaft. Light emitter and detector combination 52c may be repositioned to expose the combination to the inner surface of inner sphere 18, thereby providing a third degree of freedom to the optical joystick hereinabove described. Operation of the device is otherwise unaltered, while achieving a more compact and economical mechanism. Keeping the same longitudinal great circle of sphere 18 above detector 52c, that is above detector 52c when the joystick is in the null position for the third degree of freedom, regardless of the tilt of the shaft, maintains zero rotation of sphere 18 in the third degree of freedom.

An alternate mounting structure to the ball joint structure previously described is shown in FIG. 8. It may be seen that sphere 18 is hollow and has a smooth surface on the inside to accept support 64, hich support is likewise smooth and is shaped to conform with the interior surface of sphere 18. Support 62 may consist of two or more arcuate sections concentrically arranged with respect to the center of rotation of sphere 18 or alternately, a continuous band as shown in FIG. 8. Teflon coating or other means could be provided to ensure minimum drag. It will be seen that the surface of sphere 18 as it is turned by shaft 34 remains in constant position with respect to emitter/detector combinations 52 in the same manner as provided by the ball joint mounting structure.

Figure 9:
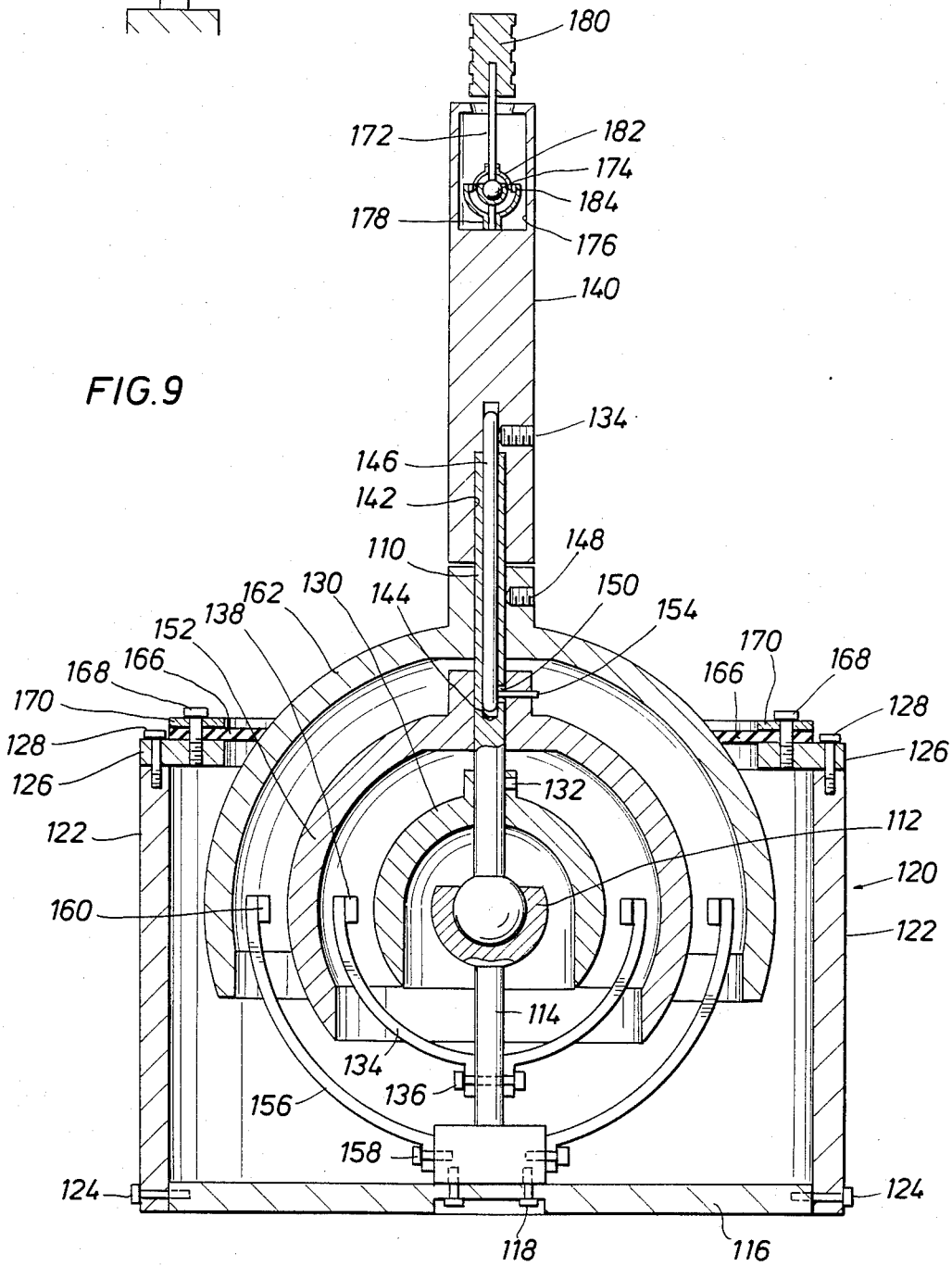
FIG. 9 is a schematic representation in vertical cross section of a preferred embodiment of the present invention.

Now referring to FIG. 9, a preferred embodiment of the present invention is shown. In this embodiment, central control shaft or rod 110 is supported in a ball joint 112 carried by a support stem 114 rigidly mounted to housing bottom plate 116 via mounting bolts 118. Housing 120 may include side plates 122, connected to bottom plate 116 by screws 124 or the like. Likewise, housing 120 may include a top plate 126 connected to side plates 122 by screws 128 or the like. Inner partial sphere 130 having a varying reflectivity surface in the manner previously described is rigidly mounted on central control rod 110 via set screws 132. The outer surface of sphere 120 is only a partial sphere and is open at the bottom so as to permit the intended tilting movement of rod 110 in the manner described above.

Also rigidly mounted to support stem 114 is inner optics bracket 134, which is joined to the stem via mounting screws or bolts 136. Carried in horizontal alignment with the center of ball joint 112 are inner ring optics 138. As described above, these optics are preferably emitter/detector combinations, one located on either side of the sphere at positions 180° apart and electrically connected in a differential mode. The inner optics ring also carries the emitter/detector combinations which are orthogonally located with respect to those which are illustrated in the cross-sectional view of FIG. 9.

Handle 140 defines an axially aligned opening 142 for receiving central control rod 110. In turn, rod 110 includes an axial internal opening 144 for receiving center pin 146. Center pin 146 is held tightly in handle 140 by handle set screw 134. It will be seen that center pin 146 is connected through a slot or notch 150 in rod 110 to center sphere 152 via center sphere retaining pin 154. Center sphere 152 is concentric with inner sphere 130 and rotates about the center of ball joint 112. An outer optics bracket 156 is rigidly secured to support stem 114 via mounting bolts 158 so that the outer optics ring 160 is positioned on a horizontal line through the center of ball joint 112 at a predetermined fixed distance from the surface of center sphere 152. In a fashion previously discussed, outer optics ring 160 may include two emitter/detector combinations located 180° apart which are electrically connected in a differential mode. The detectable surface of sphere 152 varies longitudinally so as to provide detection in the degree of rotation of handle 140 from a neutral position.

Outer sphere 162 is connected to control rod 110 via outer sphere set screw 148 and acts as a dust cover and an opaque cover to prevent the entry of light to the housing 120. Please note that the housing is further enclosed by light/dust gasket 166 which is mounted by screws 168 to top plate 126 in conjunction with an appropriate gasket retainer 170. The gasket 166 resiliently rides on the surface of outer sphere 162 as the central control rod 110 is pivoted via ball joint 112.

It may be seen that in accordance with the description given above, the outer surface of inner sphere 130 changes in optical properties from bottom to top, or latitudinally. Paint varying from white to black as perceived by the emitter/detector combinations is a convenient means for achieving this effect. Other means of changing the physical optical property is to change the surface as covered by a dot pattern, or a line pattern. That is, the density of the pattern is varied by gradually changing the size of the dots, the closeness of the lines and the like. Another means of accomplishing optical detection is via a coded line pattern which is detected by a suitable scan reader for such codes located in the inner optics ring.

In similar fashion, the surface of center sphere 152 may be treated by painting, by a variation in dot coating, by a variation in line coating or by providing a code or cryptic pattern in a latitudinal direction, the latitudinal surface in a common longitudinal plane being constant around the circumferential periphery of the sphere.

Located in the top end of handle 140 is a second and independent control rod 172 which is mounted in a ball joint 174, located in a convenient cavity 176 in the handle, support stem 178 therefor being rigidly secured inside the cavity to handle 140. A thumb screw handle 180 may be attached to second control rod 172 and have a surface adapted to facilitate contact and manipulation of the control rod, such as with a knurled or corrugated surface. Rigidly mounted to rod 172 is a miniature partial sphere 182 being substantially the same in mounting structure and optical properties as inner sphere 130, previously described. Located in a horizontal plane through the center of ball joint 174 is an optical detector ring comprising one or more emitter/detector combinations 184 in a manner previously described for other emitter/detector combinations.

It may be seen that by manipulating handle 180 with the thumb while grasping the handle 140 with the fingers of a single hand, rod 172 may be pushed forward and backwards and from side to side to effect two control output signals via miniature partial sphere 182 and the optical detectors located thereopposite in a manner which has previously be described. Hence, for the overall structure, five independent outputs are possible.

Although not illustrated in FIG. 9, it may be seen that a further output may be obtained in combination with that which is shown by making the joystick movable in an in and out or up-and-down motion and by spring loading rod 172 so that it may move in and out within the cavity of handle 140. Comparable gradual varying surface structures and oppositely aligned emitter/detector combination would produce the optical changes resulting in electrical outputs for circuits not shown.

It may be seen that the optics that can be used with the system just described can be light emitting diodes, photodiodes and the like. As previously mentioned, the differential mode of connection of emitter/detector combinations assists in ensuring that aging will not materially depreciate the output results. It will be seen that there is no wear on those parts of the optical detection scheme which are moved since there is no rubbing or surface contact. Even long use will not cause a comparable wearing of parts as with the prior art carbon potentiometers. That is, there is no wearing parts in the electrical path as with the potentiometers most commonly employed in prior art joystick operation.

There are schemes commonly known in the prior art for optically changing the resistance in a path with the amount of light impinging on the light detector. When connected in a voltage divider with respect to a bias voltage, such changing voltage can be easily employed as either a control voltage or an indicator voltage directly related to the amount of light impinging. Changes in light intensity can be controlled in a straight-line variation sense by the manner just described, in a logarithmic variation sense or otherwise. Hence, the detector part of the combinations described herein include that part of the electronics that produce a voltage variation with a change in light intensity received.

It is possible to effect the desired variation in surface coating of the spheres by various methods. To change the reflectivity properties of a sphere from white to black, it is possible to first place the sphere in a reservoir of white paint so that it is completely covered and then raise it gradually from the paint while gradually adding black paint to the paint reservoir.

Variation in dot pattern density can be provided photographically with a photo-sensitive spherical surface. Many other schemes of effecting the gradual optical property changes discussed above will become apparent to those skilled in the art.

The use of a tilting and/or rotating sphere has been described with respect to stationary emitter/detector combinations. It is also apparent that the emitter/detector combinations can be mounted for movement with respect to the joystick manipulations and the spherical surfaces can be stationarily mounted instead.

In addition to the video game application, to which the joystick which has just been described lends itself, another anticipated use for the system which appears to have great potential is in robot feedback control loops, since most cooperatively movable robot parts commonly employed already utilize ball joints for their mechanical connections.

While several embodiments of the invention have been shown and described above, it will be understood that the invention is not limited thereto since modifications may be made and will become apparent to those skilled in the art. For example, the parts are particularly suited for new technology in fiberoptics and laser technology.

Furthermore, although true spherical shapes are desirable for effecting the desirable control results described herein, deviation from spherical are also operable and, therefore, are equivalent. Hence, the terms "spherical" and "sphere" and the like also pertain herein to surfaces that may not have a true spherical geometry, but which accomplish the same functional result.

From the foregoing, it will be seen that this invention is one well adapted to attain all of the ends and objects hereinabove set forth, together with other advantages that are obvious and that are inherent to the apparatus and structure.

It will be understood that certain features and subcombinations are of utility and may be employed without reference to other features and subcombinations. This is contemplated by and is within the scope of the claims.

Because many possible embodiments may be made of this invention without departing from the scope thereof, it is to be understood that all matter herein set forth, and shown in the accompanying drawings is to be interpreted as illustrative and not in a limiting sense.

What is claimed is:

1. An optical joystick converting the variable physical position of a command control to electrical output, comprising:

a command control adapted for tilting from its neutral position with respect to a pivot location in at least a first direction and a second direction displaced 90° from said first direction, a first at least partial sphere connected to said command control such that the center of said first partial sphere coincides with the pivot location and the surface of said first partial sphere moves about the pivot location as said command control is moved, the surface of said first partial sphere varying in property to exhibit a varying optical change in said first direction of tilt and in said second direction of tilt, first optical response means positioned with respect to the surface of said first partial sphere for responding to said varying optical change in the surface of said first partial sphere in said first direction of tilt and producing a first electrical output, and second optical response means positioned with respect to the surface of said first partial sphere for responding to said varying optical change in the surface of said first partial sphere in said second direction of tilt and producing a second electrical output.

2. An optical joystick in accordance with claim 1, and including optical means connected to said command control having a surface varying in property to exhibit a varying optical change with a rotation of at least a part of said command control, and third optical response means positioned with respect to the surface of said optical means for responding to said varying optical change in the surface of said optical means and producing a third electrical output.

3. An optical joystick in accordance with claim 2, wherein said command control includes a shaft mounted for rotation and said optical means includes a second at least partial sphere concentrically mounted with said first said partial sphere and varying in said optical change property longitudinally around said second partial sphere considering the shaft as the pole.

4. An optical joystick in accordance with claim 2, wherein said optical means comprises an inner surface of said first partial sphere, said inner surface varying in said optical change property longitudinally within said first partial sphere considering the shaft as the pole.

5. An optical joystick in accordance with claim 1, wherein said command control includes a shaft pivoted in conjunction with a ball joint at said pivot location, said ball joint permitting universal tilting positioning of said command control at locations between said first and said second direction.

6. An optical joystick in accordance with claim 1, wherein the reflectivity property of the surface of said first partial sphere varies uniformly latitudinally from bottom to top in an axial direction with the command control considered as the pole.

7. An optical joystick in accordance with claim 6, wherein the reflectivity property variation of the surface of said first partial sphere is accomplished by a gradual variation in paint.

8. An optical joystick in accordance with claim 7, wherein the gradual change in paint is optically perceived from white to black.

9. An optical joystick in accordance with claim 6, wherein the reflectivity property variation of the surface of said first partial sphere is accomplished by a gradual increase in area density covered by a surface-coating dot pattern.

10. An optical joystick in accordance with claim 6, wherein the reflectivity property variation of the surface of said first partial sphere is accomplished by a gradual increase in area density covered by a surface-coating line pattern.

11. An optical joystick in accordance with claim 1, wherein the light transmitting property variation of the surface of said first partial sphere varies uniformly latitudinally from bottom to top in an axial direction with the command control considered as the pole.

12. An optical joystick in accordance with claim 11, wherein the light transmitting property variation of the surface of said first partial sphere is accomplished by a gradual increase in area density covered by a surface-coating dot pattern.

13. An optical joystick in accordance with claim 11, wherein the light transmitting property variation of the surface of said first partial sphere is accomplished by a gradual increase in area density covered by a surface-coating line pattern.

14. An optical joystick in accordance with claim 1, wherein said first spherical optical response means includes a light emitter and a light detector located on the same side of the surface of said first partial sphere.

15. An optical joystick in accordance with claim 14, wherein said first optical response means includes a second light emitter and a second light detector located on the same side of the surface of said first partial sphere and in line with said pivot location and said first-named light emitter and first-named light detector, the output of said first-named detector and said second detector being connected together in a differential mode.

16. An optical joystick in accordance with claim 1, wherein said first partial sphere is hollow and said first optical response means includes a light emitter and a light detector located on the same side of the surface of said first partial sphere.

17. An optical joystick in accordance with claim 16, wherein said first optical response means includes a second light emitter and a second light detector located on the opposite side of the surface of said first partial sphere and in line with said pivot location and with said first-named light emitter and first-named light detector, the output of said first-named detector and said second detector being connected together in a differential mode.

18. An optical joystick in accordance with claim 1, wherein said varying property of said first partial sphere is an optically coded surface and said first optical response means and said second optical response means are each optical scan readers capable of detecting the coded surface therebeneath and producing an electrical output indicative thereof.

19. An optical joystick in accordance with claim 1, wherein said first partial sphere is hollow and including a support structure having a spherical surface for bearing against the inside surface of said hollow sphere, the spherical surface of said support structure having its center at the pivot location.

* * * * *